United States Patent [19]

Jackson

[11] Patent Number: 4,502,834

[45] Date of Patent: Mar. 5, 1985

[54] APPARATUS AND METHOD OF THROTTLING CENTRIFUGAL PUMP LIQUID OUTPUT

[76] Inventor: Samuel G. Jackson, P.O. Box 16587, Lubbock, Tex. 79490

[21] Appl. No.: 363,022

[22] Filed: Mar. 29, 1982

[51] Int. Cl.[3] ..... F04B 17/00

[52] U.S. Cl. ..... 415/26; 415/17; 415/44; 415/49; 415/116; 261/27; 417/503

[58] Field of Search ..... 415/116, 117, 17, 26, 415/15, 20, 24, 44, 49; 137/88; 261/36 R, 27; 417/503, 442, 282, 306

[56] References Cited

U.S. PATENT DOCUMENTS

| | | | |
|---|---|---|---|
| 2,779,290 | 1/1957 | Wiegers | 415/116 |
| 3,508,575 | 4/1970 | Robinson | 415/26 |
| 3,726,300 | 4/1973 | Chevalier | 137/88 |
| 3,958,723 | 5/1976 | Stähle | 415/116 |
| 4,134,711 | 1/1979 | Ivans et al. | 417/370 |
| 4,165,740 | 8/1979 | Kurichev et al. | 137/88 |
| 4,290,979 | 9/1981 | Sugiura | 261/36 R |

*Primary Examiner*—Samuel Scott
*Assistant Examiner*—Brian J. Bowman
*Attorney, Agent, or Firm*—Robert A. Felsman

[57] ABSTRACT

A first control assembly is provided operative to supply gas from a supply of gas under pressure to the inlet of a centrifugal liquid pump at increasing and decreasing rates responsive to decreases and increases in the pressure of liquid discharge from the pump. The first control assembly includes spring structure for closing an associated air flow controlling valve member which is yieldingly biased toward the open position by the pressure of liquid discharged from the pump and a second control assembly is provided operative to increase and decrease the loading of the aforementioned spring structure responsive to increases and decreases in demand for liquid being discharged from the pump.

7 Claims, 6 Drawing Figures

Fig. 1
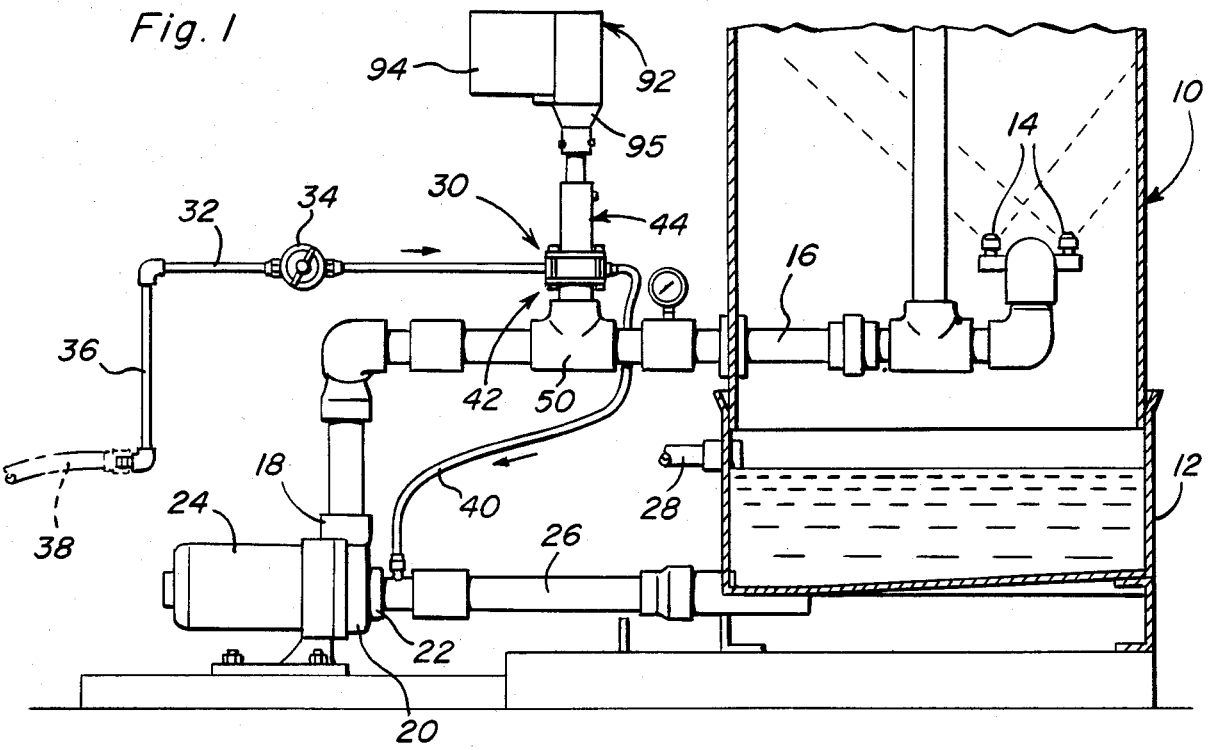
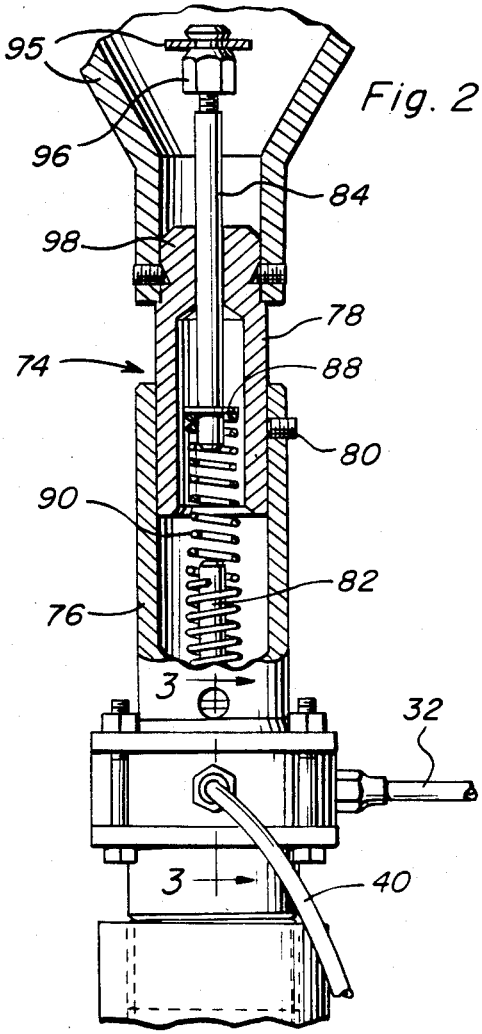
Fig. 2
Fig. 5
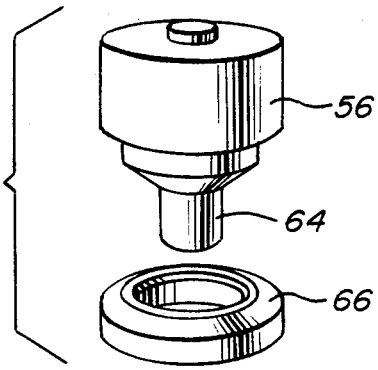
Fig. 6
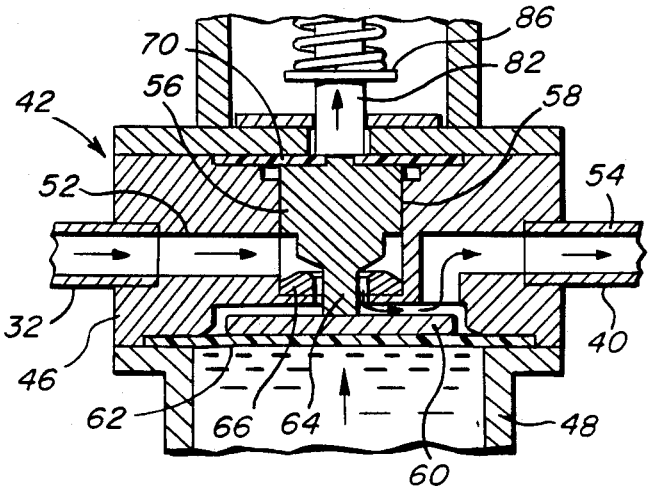

APPARATUS AND METHOD OF THROTTLING CENTRIFUGAL PUMP LIQUID OUTPUT

BACKGROUND OF THE INVENTION

It is often desirable to vary the output of a centrifugal pump. Where a centrifugal pump is utilized to recirculate water to the spray nozzles of an air washer humidifier, one should be able to vary the output of the water pump from substantially zero to the maximum output of which the pump is capable. In this respect, the term "output" applies both to pressure and volume. Since the pressure on a bank of nozzles varies approximately as the square of the volume of water forced through them, it will be seen that if the pressure can be controlled, the volume will also be controlled, and vice versa.

In humidifier applications, the evaporation of water increases the mineral concentration of the water being recirculated. This makes it difficult to use ordinary mechanical throttling valves as their working parts become jammed by scale formations. One approach to this problem is disclosed in U.S. Pat. No. 4,243,070 which pertains to a bypass valve in which the only moving part exposed to the water is an elastomer diaphragm. Unfortunately, this valve does not reduce spray nozzle pressure to substantially zero, and is, therefore, unsatisfactory for many humidifying applications. Also, bypassing a large volume of water back to the pump intake increases the power used by the pump when substantially no water is required to be pumped by the pump.

Another approach to this problem is to use a throttling valve which restricts the water flow at the pump outlet. The disadvantage of this approach is that such valves usually impose a restriction, even when fully open, so that the full output of the pump cannot be utilized. If a diaphragm or elastomer tube valve is used, destructive flutter is experienced because of the large pressure drop across the valve. Most such valves require large mechanical forces to close against the shut-off pressure of the pump, making automatic control difficult.

Another solution is to inject compressed air into the intake of a centrifugal pump. With this method, one can reduce the output of the pump to at least substantially zero. By eliminating all such injection, the maximum output of the pump is attained. This method is described in U.S. Pat. No. 3,958,723. In attempting to use only air injection to control the output of a horizontal-axis centrifugal pump, difficulties will be encountered. The output of the pump will be unstable, and can fluctuate wildly. Injecting a predetermined volume of air into the pump intake will not produce a predictable output as the depth of the water in the sump and other factors will affect the pressure. The air injection method does have the advantage of reducing the power consumed by the pump when air is injected to reduce the output. Further examples of the injection of air into the inlet of a centrifugal pump are also disclosed in U.S. Pat. Nos. 2,798,657, 3,663,117, 4,003,674 and 4,142,825. However, these various air injection devices are not readily controllably variable to the extent usually required to obtain full control of the output of a centrifugal pump, from substantially zero output to substantially full capability output.

SUMMARY OF THE INVENTION

The present invention presents a means of variably injecting air into the inlet of a centrifugal pump in such a way that the outlet pressure of the pump will be stabilized and made to conform to a predetermined value regardless of the influence of other variables.

The main object of this invention is to provide an automatic pressure control for centrifugal pumps wherein a pressure-responsive valve controls the injection of compressed air to the intake of the pump so as to stabilize and regulate the discharge pressure according to a predetermined standard.

Another object of this invention is to provide an automatic pressure control in accordance with the immediately preceding object and which will be capable of effecting the desired control in an economical manner.

Yet another object of this invention is to provide a control which has only an elastomer diaphgram exposed to the liquid whose pressure is to be controlled.

Still another important object of this invention is to provide a control which will be effective to vary the associated pump output from substantially zero to the maximum output of which the pump is capable.

Another object of this invention is to provide a control in accordance with the preceding objects and which may be effectively placed under the control various different forms of condition sensing apparatus.

A final object of this invention to be specifically enumerated herein is to provide a control which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a side elevational view of the control system of the instant invention in operative association with a centrifugal pump and attendant air washer humidifier, portions of the humidifier being broken away and illustrated in vertical section;

FIG. 2 is an enlarged elevational view of the air flow controlling valve portion of the instant invention and with sections of the valve being broken away and illustrated in vertical section;

FIG. 5 is an exploded perspective view of the valve shuttle and shuttle seat of the instant invention; and FIG. 6 is a fragmentary vertical sectional view similar to FIG. 3 but on somewhat of a reduced scale and illustrating the valve shuttle in a full open position.

DETAILED DESCRIPTION OF THE INVENTION

Figure 3:
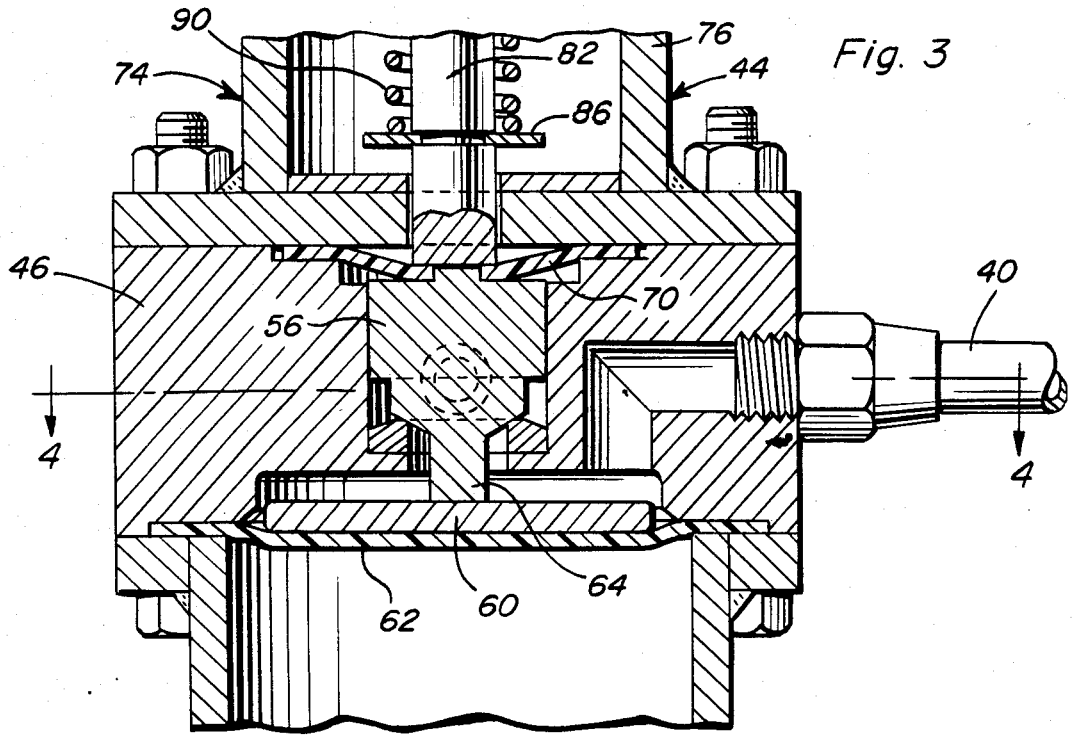
FIG. 3 is an enlarged fragmentary vertical sectional view taken substantially upon the plane indicated by the section line 3—3 of FIG. 2.
Figure 4:
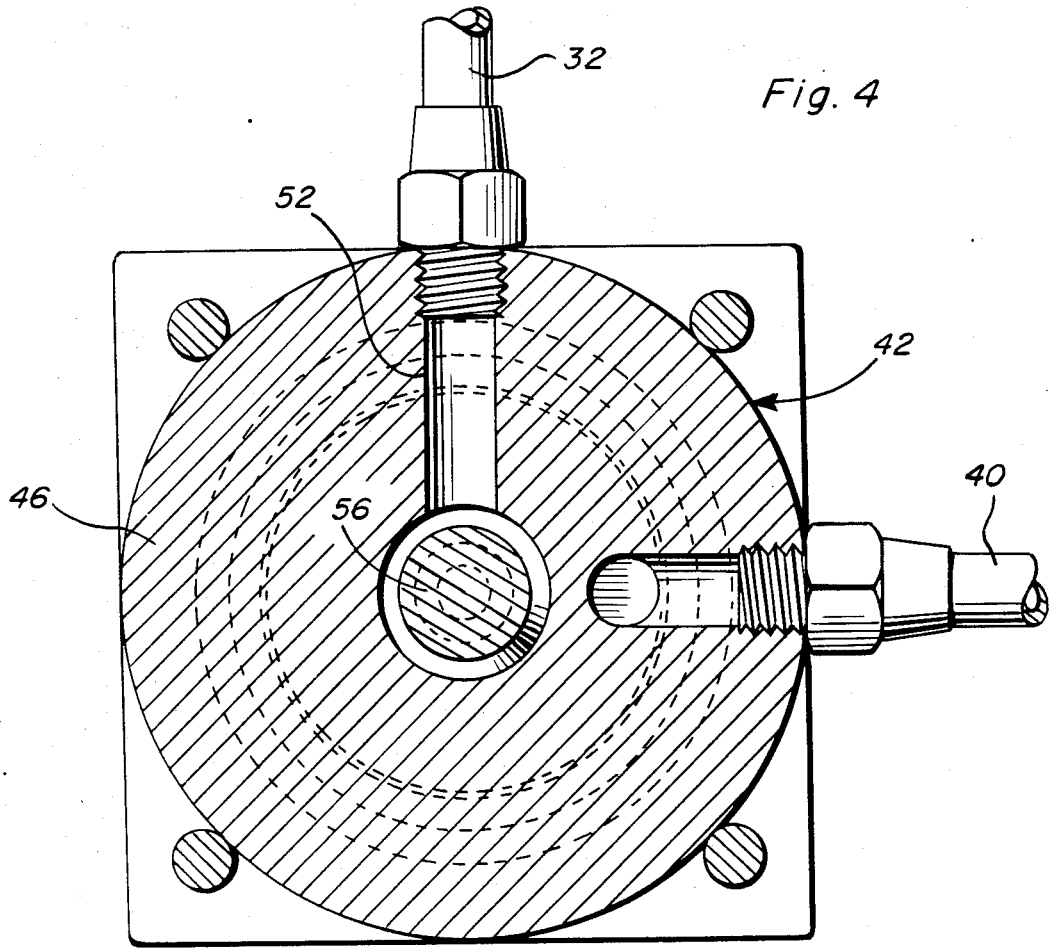
FIG. 4 is a horizontal sectional view taken substantially upon the plane indicated by the section line 4—4 of FIG. 3.

Referring now more specifically to the drawings, the numeral 10 generally designates an air washer humidifier including a lower water collecting sump portion 12 and a plurality of spray heads 14 therein to which water under pressure is supplied from a discharge pipe 16 connected to the outlet 18 of a centrifugal pump 20 also including an inlet 22 and driven by an electric motor 24. A supply pipe 26 supplies water from the lower sump portion to the inlet 22 and the sump portion 12 includes a maximum water level establishing drain pipe 28.

During operation of the air washer humidifier 10, the motor 24 is continuously operated as is conventional, but the demand for water supplied to the spray nozzles 14 may vary. In order to supply varied quantities of water to the spray nozzles 14, a control assembly referred to in general by the reference numeral 30 is provided and the control assembly includes an air line 32 having a pressure regulator 34 serially connected therein and the inlet end of the line 32 is communicated with a source of air under pressure comprising a supply line 36 whose inlet end may be connected to any suitable supply of air under pressure by a line 38. The air line 32 includes a discharge end portion 40 which opens into the supply pipe 26 closely adjacent the inlet 22 of the pump 20. The air line 32 includes an air valve assembly referred to in general by the reference numeral 42 serially connected therein between the inlet end portion and the discharge end portion 40 and the air valve assembly 42 includes a spring assembly 44 which is adjusted by a control assembly referred to in general by the reference numeral 92.

The air valve assembly 42 includes a valve body 46 mounted atop a riser pipe 48 whose lower end opens into the discharge pipe 16 through a T-coupling 50 serially connected in the discharge pipe 16. The valve body 46 includes an inlet 52 to which the inlet end portion of the air line 32 is connected and an outlet 54 to which the discharge end portion 40 of the air line 32 is connected. A valve shuttle or member 56 is mounted for vertical reciprocation in a central upstanding valve cavity 58 formed through the valve body 46 and the lower end of the shuttle 56 abuts a diaphragm backing plate 60 under which a flexible and resilient diaphragm 62 is disposed, the diaphragm 62 having its outer peripheral edges clampingly sealed between the valve body 46 and the upper end of the riser pipe 48. The diaphragm backing plate 60 upwardly abuts a depending vertical stem portion 64 of the shuttle 56 which passes downwardly through a centrally apertured resilient valve seat or seal 66 communicating the inlet 52 above the valve seat 66 with the outlet 54 below the valve seat 66. From a comparison of FIGS. 3 and 6 of the drawings it may be seen that the shuttle 56 may be shifted between a lower limit position closing the valve seat 66 and an upper limit position opening the valve seat 66 and establishing communication between the inlet 52 and the outlet 54.

The upper end of the shuttle 56 protrudes through a central hole in a flexible sealing diaphragm 70, and the lower extremity of the spring assembly 44 is mounted atop the valve assembly in position with the outer marginal edges of the diaphragm 70 sealed between opposing surfaces of the spring assembly and the valve body 46.

Water pressure within the discharge pipe 16 is operable against the underside of the diaphragm 62 and may therefore force the diaphragm 62 and the diaphragm backing plate 60 upwardly toward the uppermost limit position illustrated in FIG. 6, whereby communication is established between the inlet 52 and the outlet 54 of the valve body 46 thereby enabling maximum flow of air through the air line 32 from the source 36 to the end of the supply pipe 26 opening into the inlet 22 for the pump 20.

The spring assembly 44 includes an upstanding housing 74 including a lower tubular portion 76 and an upper tubular portion 78 which is slidingly telescoped into the upper end of the lower tubular portion 76 and secured in adjusted elevated position therein through the utilization of a set screw 80. The lower end of the lower tubular portion 76 has an upstanding lower operating rod 82 slidably received therethrough and the lower end of the operating rod 82 bears downwardly against the upper end of the shuttle 56. The upper tubular portion 78 has a second upper operating rod 84 slidably received therethrough and the rods 82 and 84 include lower end abutment washers 86 and 88 mounted thereon between which a compression spring 90 is disposed. Further, the control assembly 92 includes an actuator 94 and actuator linkage 95 mounted atop the upper tubular portion 78. The control assembly 92 may be of any conventional type, such as various automatic control actuators and linkages made by Honeywell, Inc. The Honeywell actuators include a pneumatic actuator which may downwardly displace the operating rod 84 in order to compress the spring 90 proportionally to a 3 to 15 psi air signal or any of several different Modutrol motors used with their Q618A valve linkage, which produces a vertical linear motion. Examples of such Modutrol motors which have been used in this manner include the M941A for operation by a potentiometer and the M744A which assumes a position proportional to an input of 4 to 20 milliamperes from an electronic control. It is also possible to modify an electronic Modutrol motor to respond to the difference in temperature between two thermisters sensing wet bulb and dry bulb temperatures of the air produced by the humidifier 10. This maintains a constant wet bulb depression which, at a constant temperature, maintains a constant relative humidity.

The upper end of the rod 84 includes a special nut 96 therein shaped to receive the various Honeywell actuators or linkages and the Honeywell devices also attach to the upper end of the upper tubular portion 78 by the shaped head 98 thereon.

The downward force on the rod 84 by the control assembly 92 is transmitted through the spring 90 to the lower operating rod 82 which exerts a predetermined downward loading on the shuttle 56. The pressure of liquid within the discharge pipe 16 bears upward against the diaphragm 62 and the diaphragm backing plate 60 in turn pushing upward on the valve shuttle 56. It will be seen that the valve shuttle 56 is therefore acted upon by two opposing forces. If the spring force is greater than the force exerted by the water pressure, the shuttle 56 will be held against the resilient seal or seat 66, preventing the passage of compressed air through the air line 32 to the supply pipe 26. If the balance of forces is reversed, air will then be allowed to pass from the source 36 to the end of the supply line 26 immediately adjacent the inlet 22 of the pump 20 where it will reduce the discharge of water from the pump.

The selection of the spring 90 is dictated by several considerations and the spring assembly is adapted to accept different springs in lieu of the spring 90. When the rod 84 is moved to its upper position by the actuator 94, the spring force acting downwardly on the operating rod 82 should be almost zero so the discharge pressure will become almost zero in order to achieve a balance of forces. When the actuator 94 has moved the operating rod 84 downward through its standard stroke of approximately 0.8", the force exerted by the spring 90 should be slightly greater than the force exerted by the maximum water pressure acting upon the underside of the diaphragm 62. If the area of the diaphragm backing plate 60 is approximately 2 square inches and the maximum output of the pump is 20 pounds per square inch when discharging into the discharge pipe 16, then the force which the spring must exert is approximately 40 pounds. In this case, a spring constant of 50 pounds per square inch would be required. Of course, different springs having the same inside and outside diameters, but of different lengths, may be utilized to obtain various springs constants. In order to accommodate different lengths of springs, the height of the upper tubular portion 78 relative to the lower tubular portion 76 is adjusted.

It may, therefore, be seen that in response to various types of signals, the actuator 94 may cause varied quantities of air under pressure to pass through the air valve assembly 42 and to be injected into the supply pipe 26 immediately upstream from the inlet 22 in order to reduce the discharge of water from the pump 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a water supply system including a centrifugal pump having a pump inlet for receiving a supply of liquid and a pump outlet for discharging liquid to a point of use, and liquid demand sensing control means responsive to increases and decreases in demand for liquid at the point of use, an improved flow control valve for controlling a supply of pressurized gas to the pump inlet to vary the liquid discharge from the pump, comprising:

a valve body having an inlet passage connected to a source of pressurized gas and an outlet passage connected to the pump inlet;

the valve body having a shuttle cavity located between and in communication with the inlet and outlet passages;

a valve seat in the shuttle cavity having an aperture therethrough through which gas from the inlet passage must flow to reach the outlet passage;

a valve shuttle reciprocally mounted in the shuttle cavity adjacent the seat, the shuttle being movable between a lower position in contact with the seat and blocking the flow of gas from the inlet passage, to an upper position allowing gas to flow around the shuttle and through the aperture; and a diaphragm mounted to a lower side of the valve body below the seat, having a lower side exposed to liquid pressure downstream of the pump outlet for movement in response to the liquid pressure, the upper side of the diaphragm engaging a lower end of the shuttle to apply an upward force to move the shuttle in response to movement of the diaphragm to increase air flow through the seat in response to an increase in liquid discharge pressure, the diaphragm separating the shuttle from any direct exposure to liquid;

the sensing control means engaging an upper end of the shuttle to apply a downward force to the shuttle axially opposite the upward force of the diaphragm in response to changes in demand for liquid at the point of use, to thereby vary the amount of air admitted through the seat and the amount of liquid discharged from the pump.

2. The valve according to claim 1 wherein the sensing control means includes spring means yieldingly biasing the shuttle toward the lower position.

3. The valve according to claim 1 wherein the shuttle has a depending stem portion that extends through the aperture of the seat and is engaged by the upper side of the diaphragm.

4. In a water supply system including a centrifugal pump having a pump inlet for receiving a supply of liquid and a pump outlet for discharging liquid to a point of use, liquid demand sensing control means responsive to increases and decreases in demand for liquid at the point of use, an improved flow control valve for controlling a supply of pressurized gas to the pump inlet to vary the liquid discharge from the pump, comprising:

a valve body having an inlet passage connected to a source of pressurized gas and an outlet passage connected to the pump inlet;

the valve body having a shuttle cavity located between and in communication with the inlet and outlet passages;

a valve seat in the shuttle cavity, having an aperture therethrough through which gas from the inlet passage must flow to reach the outlet passage;

a valve shuttle reciprocally mounted in the shuttle cavity adjacent the seat, the shuttle being movable between a lower position in contact with the seat and blocking the flow of gas from the inlet passage, to an upper position allowing gas to flow around the shuttle and through the aperture;

a lower diaphragm mounted to a lower side of the valve body below the seat, having a lower side exposed to liquid pressure downstream of the pump outlet for movement in response to the liquid pressure, the upper side of the lower diaphragm engaging a lower end of the shuttle to apply an upward force to move the shuttle in response to movement of the lower diaphragm to increase air flow through the seat in response to an increase in liquid discharge pressure, the lower diaphragm separating the shuttle from any direct exposure to liquid;

an upper diaphragm mounted to an upper side of the valve body in contact with an upper end of the shuttle and sealing the pressure of the gas in the shuttle cavity;

the sensing control means engaging the upper side of the upper diaphragm to apply a downward force to the shuttle axially opposite the upward force of the lower diaphragm in response to changes in demand for liquid at the point of use, to thereby vary the amount of air admitted through the seat and the amount of liquid discharged from the pump.

5. The valve according to claim 4 wherein the sensing control means includes spring means yieldingly biasing the shuttle toward the lower position.

6. The valve according to claim 4 wherein the shuttle has a depending stem portion that extends through the aperture of the seat and is engaged by the upper side of the lower diaphragm.

7. The valve according to claim 4 wherein the shuttle has a rod portion extending upwardly through a central hole in the upper diaphragm, the rod portion being contacted by a depending rod of the sensing control means.

* * * * *